United States Patent [19]

Brown

[11] Patent Number: 4,566,631

[45] Date of Patent: Jan. 28, 1986

[54] ELECTRICALLY INSULATING RAILWAY RAILS FROM RAIL-FASTENING MEANS

[75] Inventor: Trevor P. Brown, Orpington, England

[73] Assignee: Pandrol Limited, London, England

[21] Appl. No.: 466,495

[22] Filed: Feb. 15, 1983

[30] Foreign Application Priority Data

Feb. 15, 1982 [GB] United Kingdom ..... 8204364

[51] Int. Cl.[4] ..... E01B 9/30; E01B 9/34

[52] U.S. Cl. ..... 238/349; 238/338

[58] Field of Search ..... 238/152, 310, 338, 349, 238/351

[56] References Cited

U.S. PATENT DOCUMENTS

| | | | |
|---|---|---|---|
| 3,463,394 | 8/1969 | Jones et al. | 238/349 X |
| 4,104,483 | 8/1978 | Seeley | 238/349 X |
| 4,274,582 | 6/1981 | Fee | 238/349 |
| 4,306,677 | 12/1981 | Fischer | 238/349 |

FOREIGN PATENT DOCUMENTS

| | | | |
|---|---|---|---|
| 2268111 | 11/1975 | France | 238/349 |
| 1107076 | 3/1968 | United Kingdom | 238/349 |
| 1126697 | 9/1968 | United Kingdom | 238/349 |
| 2095311 | 9/1982 | United Kingdom | 238/338 |

*Primary Examiner*—Randolph A. Reese

*Attorney, Agent, or Firm*—Norbert P. Holler

[57] ABSTRACT

An insulating device comprising an electrically insulating member and a metallic reinforcing member is to electrically insulate a flange-footed railway rail from a rail clip, which bears downwardly upon the upper surface of the rail flange, and from an anchorage for the clip, this anchorage being at one side of the rail flange. A first portion of the insulating member, which is to lie on the rail flange, is surmounted by an elongate portion, having a flat bottom, of the reinforcing member and a second portion of the insulating member is to be between the edge of the rail flange and the anchorage. The reinforcing member has at least one reinforcing rib extending along and upwardly from the elongate portion and it has two sideways projections which are to extend on opposite sides of the anchorage to prevent the reinforcing member moving along the rail. No part of the reinforcing member is below the plane containing the flat bottom of the elongate portion.

5 Claims, 12 Drawing Figures

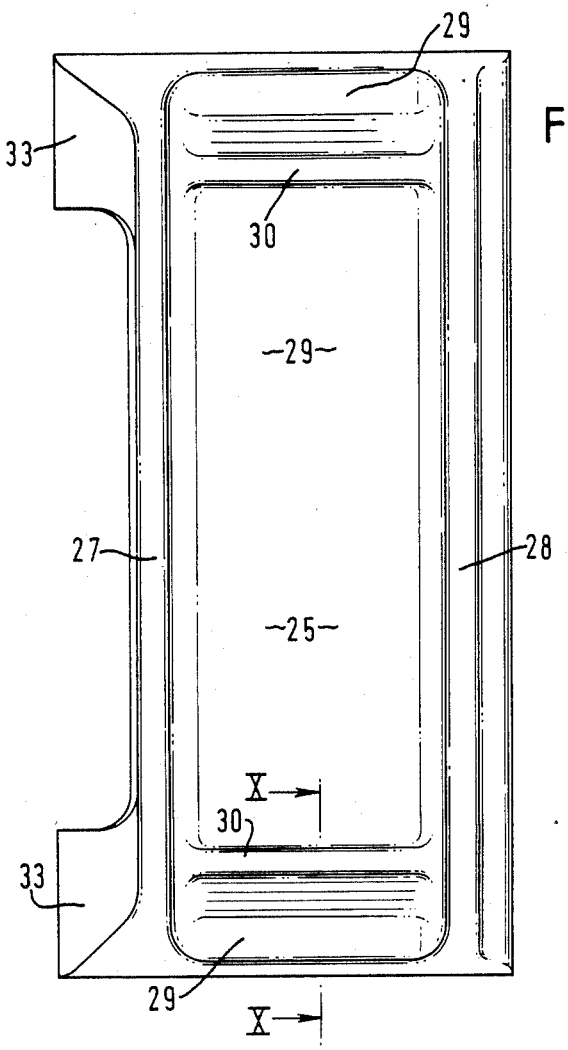
FIG. 7.
FIG. 10.
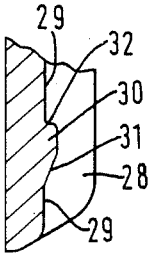
FIG. 8.
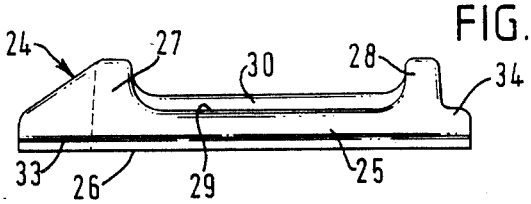

ELECTRICALLY INSULATING RAILWAY RAILS FROM RAIL-FASTENING MEANS

According to the invention, there is provided a device which is suitable for use in a railway track to electrically insulate a flange-footed railway rail from a clip, which bears downwardly upon the upper surface of the rail flange, and from an anchorage, at one side of the rail flange, for the rail clip, the device comprising an electrically insulating member having a first portion which is to be interposed between the rail clip and the upper surface of the rail flange and also having a second portion which is to be interposed between the edge of the rail flange and the anchorage and which extends downwardly from one side of the first portion and terminates in a terminal edge of the electrically insulating member vertically below said one side, the device also comprising a metallic reinforcing member comprising an elongate portion, which has a flat lower surface and is to be interposed between the rail clip and the first portion of the insulating member, first and second spaced-apart and substantially parallel reinforcing ribs which extend along and upwardly from said elongate portion near opposite sides thereof, the first rib being the nearer to the second portion of the electrically insulating member, two spaced-apart projections extending sideways from the remainder of said reinforcing member, between which part of the anchorage is to lie so that said reinforcing member cannot move far along the rail, and no part below said flat surface.

Preferably, the projections extend sideways both from one side of the elongate portion of the reinforcing member and from the first rib, in which case the root of each projection may extend over the entire height of the rib.

The upper surface of the elongate portion is preferably flat and parallel to its lower surface except at the ribs. The thickness of the elongate portion except at the ribs is preferably more than 3 mm., preferably 4 mm. or more.

Preferably, the elongate portion of the reinforcing member lies between two upstanding walls of the insulating member at opposite ends of the elongate portion in order to limit lengthwise movement of the reinforcing member with respect to the insulating member. For the same purpose, there may instead or in addition be two spaced-apart projections extending sideways from the remainder of the insulating member, between which part of the anchorage is to lie.

Preferably, the distance between said projections is in the range 50 to 100 mm., for example about 76 mm.

Examples in accordance with the invention are described below with reference to the accompanying drawings, in which:

FIG. 7 shows a plan view of a reinforcing member,

FIG. 8 shows an end view of the reinforcing member,

FIG. 10 shows a cross-section of the reinforcing member, taken as indicated by the arrows X in FIG. 7.

Figure 1:
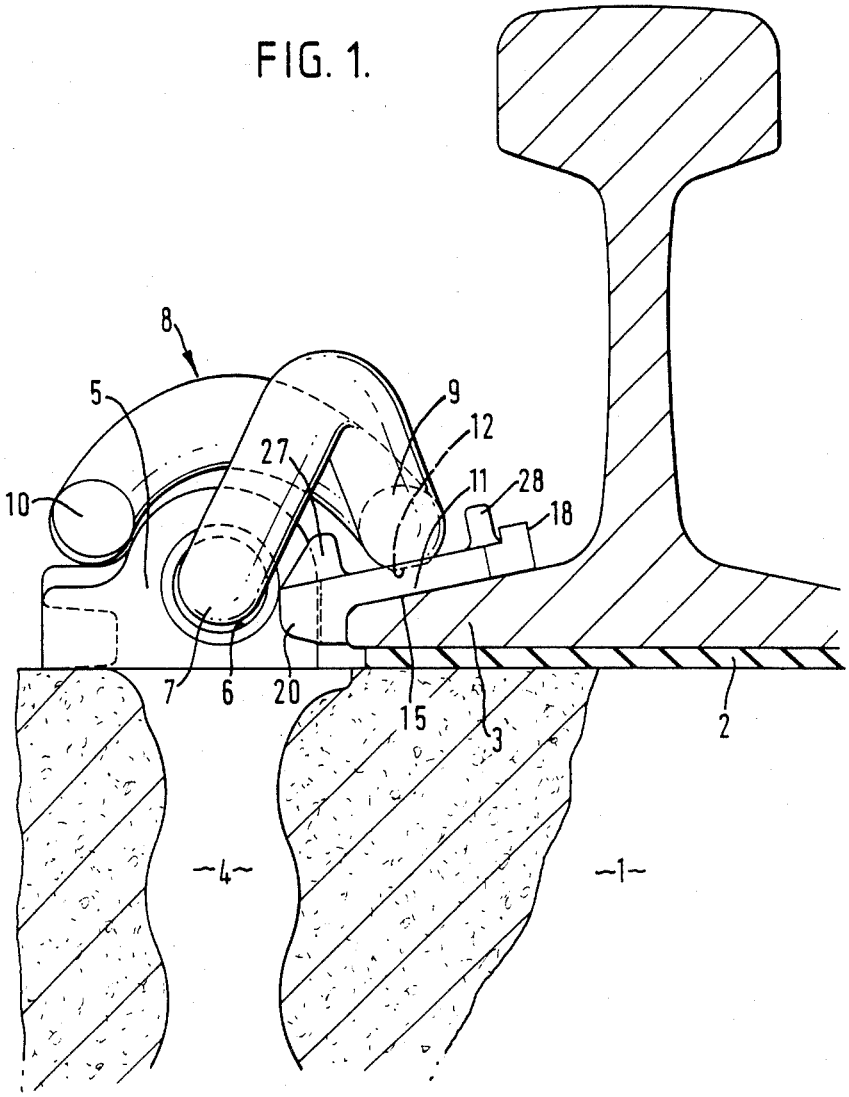
FIG. 1 shows an end view of an assembly on a railway track.
Figure 2:
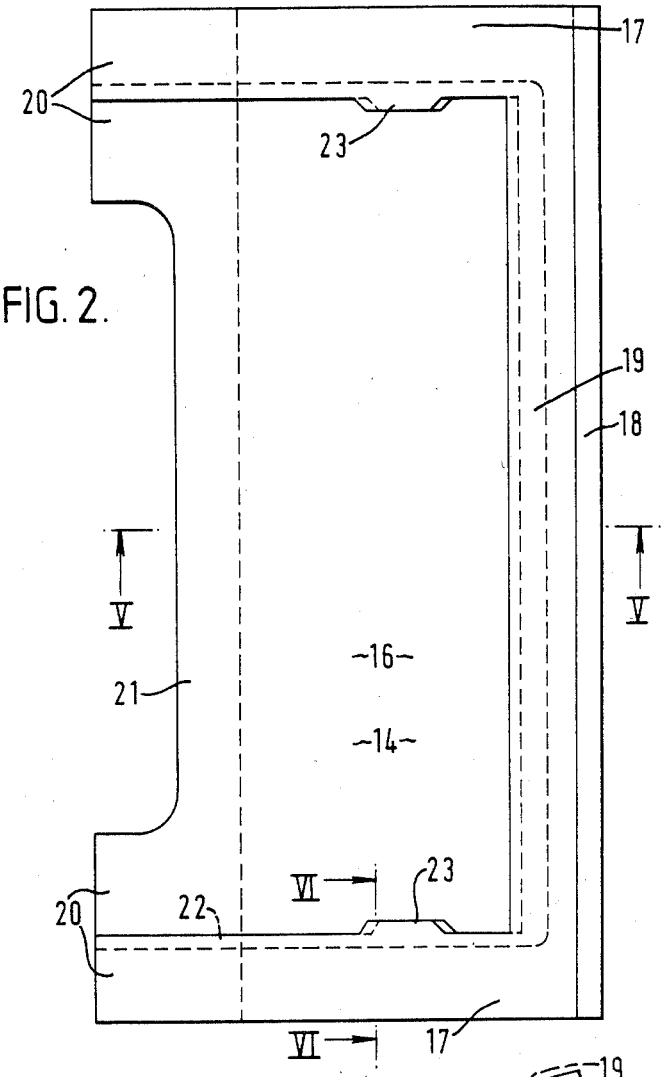
FIG. 2 shows a plan view of an insulating member.

FIG. 1 shows a concrete railway sleeper 1, a pad 2 lying on the sleeper, a railway rail standing on the pad, the flange at the bottom of the rail being referenced 3, and an anchoring device having a tail part 4 in the concrete and a head part 5 above the concrete. The head part 5 has a hole 6 through it and into the hole a straight leg 7 of a clip 8 is driven, the clip having a portion 9 pressing downwardly on the flange 3 and a portion 10 bearing downwardly on the head part 5. Between the portion 9 of the clip and the flange 3 and between the flange and the head part 5 there is interposed an insulating device 11 which includes an electrically insulating member and a metal reinforcing member having a surface which is in direct contact with and parallel to a flat surface 12 at the bottom of the portion 9 of the clip.

A modified version of the insulating device 11 is shown in FIGS. 2 to 12.

Figure 3:
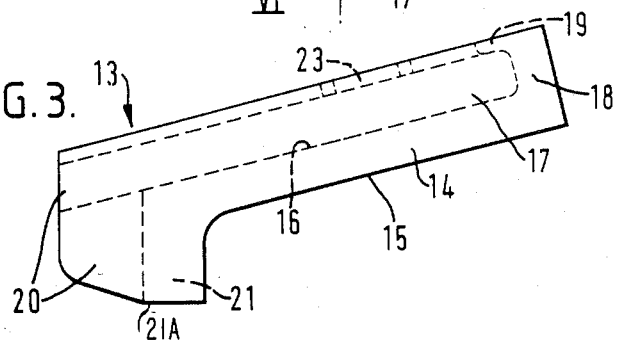
FIG. 3 shows an end view of the insulating member.
Figure 4:
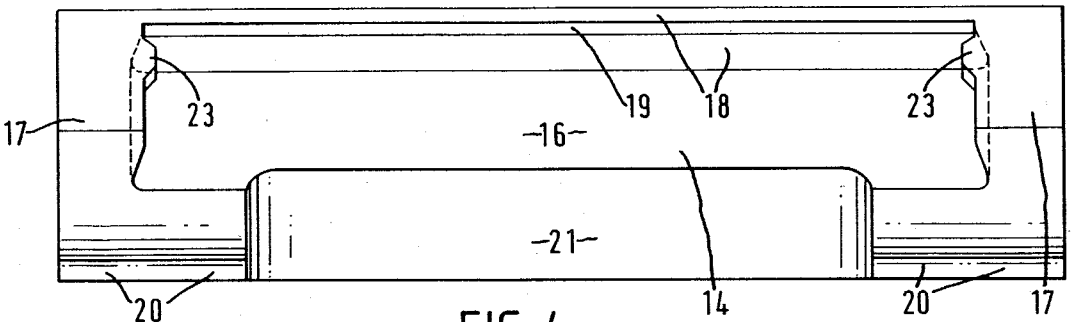
FIG. 4 shows a side view of the insulating member.
Figure 5:
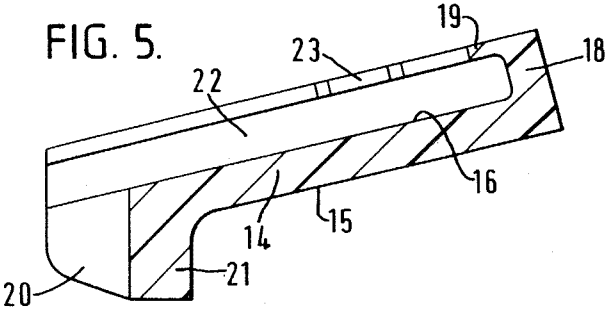
FIGS. 5 and 6 show cross-sections of the insulating member, taken as indicated by the arrows V and VI, respectively, in FIG. 2.
Figure 6:
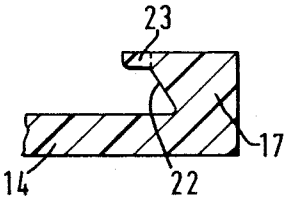
Figure 9:
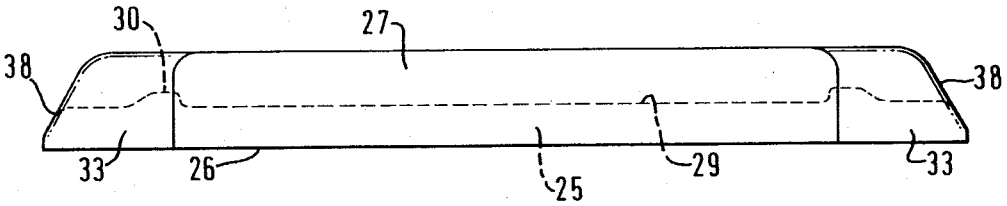
FIG. 9 shows a side view of the reinforcing member.
Figure 12:
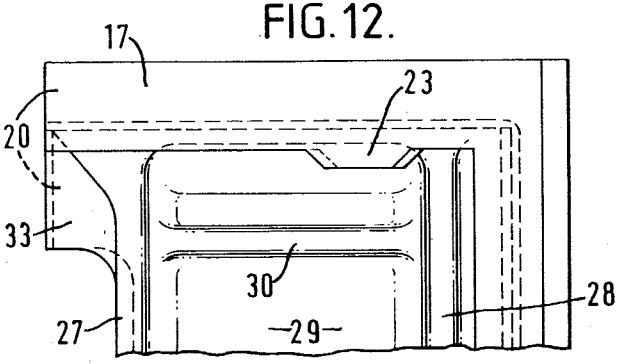
FIG. 12 shows a plan view of one end of the same device.

The insulating member 13 shown in FIGS. 2 to 6 consists of an elongate member molded from nylon or other suitable material, the cross-section being somewhat L-shaped and the length being about 12 to 13 cm. One limb 14 of the L has a flat surface 15 which, in use of the device 11, is parallel to and in contact with the upper face of the flange 3, the limb 14 being in the form of a flat plate about 5 to 6 mm. thick having a flat upper surface 16, parallel to the surface 15, two upstanding end walls 17 and an upstanding side wall 18, from the top of which a ledge 19 extends towards two projections 20 at opposite ends of the other limb 21 of the L. The limb 21 extends downwardly from the left-hand side of the limb 14 as seen in FIG. 3 and terminates in a terminal edge 21A of the member 13 vertically below that left-hand side. The walls 17 extend into the projections 20 so that the roots of the projections, on their right-hand sides considering FIG. 3, extend up the entire height of the limb 21 and the entire height of the walls 17. The walls 17 have inclined inner faces 22 and the reinforcing member has inclined end faces 38 so that parts of the walls 17 overlie the end portions of the reinforcing member. Two projections 23 extend towards one another from the tops of the walls 17.

The reinforcing member 24 is made of cast malleable iron and it includes an elongate portion 25, between 4 and 5 mm. thick, which has a flat lower surface 26. No part of the reinforcing member lies below the plane containing that surface. Two spaced-apart and parallel reinforcing ribs 27 and 28 extend upwardly from the portion 25. They extend along the entire length, about 105 to 110 mm., of opposite sides of the portion 25 although their height decreases at both ends. Between the roots of these ribs the upper surface 29 of the portion 25 is flat and parallel to the surface 26 except where two ribs 30, not so tall as the ribs 27 and 28 and perpendicular to them, extend upwardly from the portion 25, these ribs each having an inclined flank 31 on one side and a substantially vertical flank 32 on the other side. From opposite ends of the rib 27 two projections 33 extend away from the rib 28.

The roots of the projections 33, on their right-hand sides considering FIG. 8, extend up the entire thickness of the portion 25 and up the entire height of the rib 27 and the lower surfaces of the projections 33 are flush with the surface 26. On the side of the rib 28 remote from the rib 27 there is a ledge 34.

Figure 11:
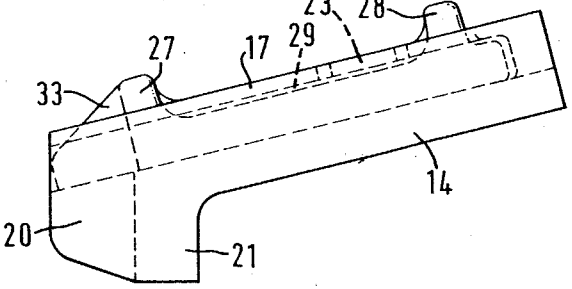
FIG. 11 shows an end view of device comprising the two members shown in FIGS. 2 to 10.

To assemble the insulating member 13 with the reinforcing member 24, the surface 26 of the reinforcing member is placed on the surface 16 of the insulating member and then the reinforcing member is pushed to the right, considering FIG. 11, until the ledge 34 lies under the ledge 19. The projections 23 are deformed, allowing the ledge 34 and the ends of the rib 28 to pass them, and then spring back to their illustrated positions, where they hold the surfaces 16 and 26 firmly in contact with one another and prevent the reinforcing member moving back to the left, considering FIG. 11. The flat surface 29 on the reinforcing member is lower than the tops of the walls 17.

The flat surface 12 of the clip is parallel to and in direct contact with the flat surface 29 on the reinforcing member and one of the ribs 30, depending upon the direction in which the clip is driven, prevents withdrawal of the straight leg 7 of the clip from the hole 6. One or both of the ribs 30 could, however, be omitted. The projections 23 could be omitted so that the members 13 and 24 are readily separable.

The reinforcing member, instead of being made of cast metal, could be made by a rolling or extruding operation followed by a cropping operation for removing material from the space which, in the finished article, is between the two projections 33.

The insulating device 11 shown in FIG. 1 is similar to that shown in FIGS. 2 to 12, the reinforcing member again having the two ribs 27 and 28, the two projections 33 and no part below the plane containing the surface 26. However, the wall 18 is taller and the ledge 19 higher than in the example shown in FIGS. 2 to 12.

I claim:

1. A device which is suitable for use in a railway track to electrically insulate a flange-footed railway rail from a rail clip, which bears downwardly upon the upper surface of the rail flange, and from an anchorage, at one side of the rail flange, for the rail clip, the device comprising an electrically insulating member having a first portion which is to be interposed between the rail clip and the upper surface of the rail flange and also having a second portion which is to be interposed between the edge of the rail flange and the anchorage and which extends downwardly from one side of the first portion and terminates in a terminal edge of the electrically insulating member vertically below said one side, the device also comprising a metallic reinforcing member comprising an elongate portion, which has a flat lower surface and is to be interposed between the rail clip and the first portion of the insulating member, first and second spaced-apart and substantially parallel reinforcing ribs which extend along and upwardly from said elongate portion near opposite sides thereof, the first rib being the nearer to the second portion of the electrically insulating member, two spaced-apart projections extending sideways from the remainder of said reinforcing member, between which part of the anchorage is to lie so that said reinforcing member cannot move far along the rail, and no part below said flat lower surface, there being near one end or each end of the reinforcing member a further rib projecting upwardly from said elongate portion, perpendicular to the reinforcing ribs and less tall than the latter.

2. A device according to claim 1 in which the or each further rib has an inclined flank on one side and a more nearly perpendicular flank on the opposite side.

3. A device which is suitable for use in a railway track to electrically insulate a flange-footed railway rail from a rail clip, which bears downwardly upon the upper surface of the rail flange, and from an anchorage, at one side of the rail flange, for the rail clip, the device comprising an electrically insulating member having a first portion which is to be interposed between the rail clip and the upper surface of the rail flange and also having a second portion which is to be interposed between the edge of the rail flange and the anchorage and which extends downwardly from one side of the first portion and terminates in a terminal edge of the electrically insulating member vertically below said one side, the device also comprising a metallic reinforcing member comprising an elongate portion, which has a flat lower surface and is to be interposed between the rail clip and the first portion of the insulating member, first and second spaced-apart and substantially parallel reinforcing ribs which extend along and upwardly from said elongate portion near opposite sides thereof, the first rib being the nearer to the second portion of the electrically insulating member, two spaced-apart projections extending sideways from the remainder of said reinforcing member, between which part of the anchorage is to lie so that said reinforcing member cannot move far along the rail, and no part below said flat lower surface, the insulating member having two spaced-apart projections extending sideways from the remainder of the insulating member, these projections lying adjacent said projections on the reinforcing member.

4. A device according to claim 3 in which the end walls on the insulating member extend into the projections on the insulating member.

5. A device according to claim 3 in which said projections on the insulating member lie at least partly under said projections on the reinforcing member.

* * * * *